US010696474B2

(12) United States Patent
Niu

(10) Patent No.: US 10,696,474 B2
(45) Date of Patent: Jun. 30, 2020

(54) CARRIAGE DECKING DEVICE

(71) Applicant: ZHEJIANG TOPSUN LOGISTIC CONTROL CO., LTD, Zhejiang (CN)

(72) Inventor: Shengliang Niu, Taizhou (CN)

(73) Assignee: Zhejiang Topsun Logistic Control Co., Ltd., Taizhou (CN)

( * ) Notice: Subject to any disclaimer, the term of this patent is extended or adjusted under 35 U.S.C. 154(b) by 770 days.

(21) Appl. No.: 15/512,878

(22) PCT Filed: Feb. 5, 2015

(86) PCT No.: PCT/CN2015/072296
§ 371 (c)(1),
(2) Date: Aug. 4, 2017

(87) PCT Pub. No.: WO2016/045295
PCT Pub. Date: Mar. 31, 2016

(65) Prior Publication Data

US 2019/0382194 A1 Dec. 19, 2019

(30) Foreign Application Priority Data

Sep. 23, 2014 (CN) ..... 2014 1 0490254

(51) Int. Cl.
*B65D 90/00* (2006.01)
*B65D 88/12* (2006.01)
(Continued)

(52) U.S. Cl.
CPC ..... *B65D 90/0073* (2013.01); *B65D 88/121* (2013.01); *A47B 57/10* (2013.01);
(Continued)

(58) Field of Classification Search
CPC ..... B65D 90/0073; B65D 88/121; B65D 2590/0041; B65D 90/00; B65D 2590/005;
(Continued)

(56) References Cited

U.S. PATENT DOCUMENTS 982,279 A * 1/1911 Knape ..... A47B 57/567 248/244
2,861,695 A * 11/1958 Carbary ..... F25D 25/02 108/138
(Continued)

FOREIGN PATENT DOCUMENTS

CN 203006189 U 6/2013
CN 203020831 U 6/2013
(Continued)

OTHER PUBLICATIONS

International Search Report of PCT/CN2015/072296.

*Primary Examiner* — Hanh V Tran
(74) *Attorney, Agent, or Firm* — Minder Law Group; Willy H. Wong

(57) ABSTRACT

The carriage decking device comprises four deck maneuver rails arranged in pairs and opposite one another, and connectors, connected at the deck maneuver rails, and which are capable of sliding up and down along the deck maneuver rails. A certain number of positioning holes are axially distributed on the deck maneuver rails. Yokes are connected on external sides of each connector, and partitions are fastened between the yokes. A depressed mounting cavity is provided on the internal side of each yoke, and a stop pin is provided inside the mounting cavity. A connecting hole that aligns with the stop pin is provided on each connector, and the stop pin extends into the connecting hole. A clutch that enables the stop pins in the mounting cavities to connect with the positioning holes of corresponding deck maneuver rails or to detach from the positioning holes simultaneously is provided between two neighboring yokes.

18 Claims, 5 Drawing Sheets

(51) Int. Cl.
*A47B 57/34* (2006.01)
*A47B 57/54* (2006.01)
*A47B 57/10* (2006.01)
*A47B 57/26* (2006.01)

(52) U.S. Cl.
CPC ..... *A47B 57/265* (2013.01); *A47B 57/34* (2013.01); *A47B 57/545* (2013.01); *B65D 2590/0041* (2013.01)

(58) Field of Classification Search
CPC ..... A47B 57/10; A47B 57/26; A47B 57/265; A47B 57/34; A47B 57/54; A47B 57/545; A47B 57/56; A47B 57/562; A47B 57/567; A47B 57/588; F25D 25/02
See application file for complete search history.

(56) References Cited

U.S. PATENT DOCUMENTS 3,885,846 A * 5/1975 Chuang ..... A47B 57/482 312/306
3,982,801 A * 9/1976 Heidorn ..... A47B 57/06 312/306
4,848,608 A * 7/1989 Anderson ..... A47B 57/10 211/71.01
5,199,778 A * 4/1993 Aoki ..... A47B 57/32 312/408
5,678,715 A 10/1997 Sjostedt et al.
6,105,794 A * 8/2000 Bauer ..... A47B 57/26 108/108
9,109,804 B2 * 8/2015 Armstrong ..... F24C 15/16
9,353,988 B2 * 5/2016 Liu ..... F25D 25/02
9,513,048 B2 * 12/2016 Choo ..... F25D 25/02
10,006,692 B2 * 6/2018 Erol ..... F25D 23/067
2008/0246382 A1 * 10/2008 Kang ..... A47B 57/06 312/408
2010/0117502 A1 * 5/2010 Kang ..... F25D 25/02 312/408
2010/0171402 A1 * 7/2010 Yoon ..... F25D 25/02 312/408
2011/0290807 A1 * 12/2011 Calvillo ..... F25D 25/02 220/592.02
2012/0018255 A1 * 1/2012 Gross ..... B65F 7/28 187/207
2013/0081421 A1 * 4/2013 Kwon ..... F25D 23/04 62/440
2015/0014264 A1 * 1/2015 Linnell, Sr. ..... B07C 7/02 211/187

FOREIGN PATENT DOCUMENTS

CN 203020832 U 6/2013
CN 203064555 U 7/2013
CN 203229097 U 10/2013
CN 203332732 U 12/2013
CN 104291035 A 1/2015
CN 204137651 U 2/2015

* cited by examiner

CARRIAGE DECKING DEVICE

RELATED APPLICATIONS

This application is a national stage entry of International Application No. PCT/CN2015/072296, filed Feb. 5, 2015, and claims benefit of Chinese Patent Application No. CN 201410490254.6, filed Sep. 23, 2014.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention pertains to the technical field of mechanical technology, and particularly to a carriage decking device.

Related Art

In order to save transportation costs, and improve transport capacity of goods, a large number of goods will be stacked in the carriage during transportation. However, the turbulence of vehicle during transport process is likely to cause damage to the goods. Some people have thought of placing a semi-enclosed shelve in the carriage, with a partition fastened on the shelf, so the shelf is separated by a partition into a number of vertically adjacent storage cavities, and the goods are placed in each cavity. However, the shelf itself requires to occupy a certain amount of space in the carriage, and the partition is being fastened to the shelf, thus the storage cavity space cannot be adjusted, which is only applicable to specific goods. If the size of goods is small, the utilization rate of storage cavity is low, and if the goods are large, they cannot be stored. Therefore, the applicability is poor.

A decking device for cargo compartment was proposed by the applicant [patent number: ZL201220663809.9; Publication No.: CN203020831U], which comprises strip-shaped positioning rails to be fastened on internal sides of cargo compartment. A certain number of positioning holes are axially distributed on the positioning rails. A supporting joist is positioned in-between two adjacent parallel positioning rails. Fasteners are provided at both ends of the supporting joist. Fasteners are connected on the positioning rails and capable of sliding horizontally along the positioning rails. A fastening structure is provided in-between the fastener and positioning rail, and the fastener tends to be embedded into the positioning hole under the action of fastening structure, causing the fastener and positioning rail to keep in position. Positioning rails are provided in parallel and aligned at the internal side of cargo compartment. Both ends of the supporting joist are positioned at the positioning holes through fastening structure. The supporting joist is used to divide the space inside cargo compartment to avoid stacking of cargo, and users can also vertically adjust the position of supporting joist depending on the size of goods.

Since the decking device is only positioning one supporting joist, the supporting joist is long-strip shaped, and the cargo compartment space is generally larger, so it is necessary to use multiple sets of decking device. The purpose of decking can actually be achieved through the combined effect of supporting joist on these decking devices. However, the use of multiple decking sets will increase transportation costs, and if the volume of cargo is changed, it is necessary to re-adjust the height of supporting joist. As each decking device corresponds to only one supporting joist, it is therefore necessary to adjust the height of supporting joists successively on each decking device. Thus the adjustment is very cumbersome, and it is very time and labor consuming.

SUMMARY OF THE INVENTION

One objective of one embodiment of the present invention is to propose a carriage decking device that can increase the decking area and at the same time can be easily adjusted, to solve the aforementioned problems of prior art.

One objective of one embodiment of present invention can be achieved by the following technical solutions:

A carriage decking device comprises four deck maneuver rails arranged in pairs and opposite one another, and connectors, connected at the deck maneuver rails, and which are capable of sliding up and down along the deck maneuver rails. A certain number of positioning holes are axially distributed on the deck maneuver rails. The device is characterized in that, yokes are connected on external sides of each connector, and partitions are fastened between the yokes. A depressed mounting cavity is provided on the internal side of the yoke, and a stop pin is provided inside the mounting cavity. A connecting hole that aligns with the stop pin is provided on the connector, and the stop pin extends into the connecting hole. A clutch that enables the stop pins in the mounting cavities to connect with the positioning holes of corresponding deck maneuver rails or to detach from the positioning holes simultaneously is provided between two neighboring yokes.

Deck maneuver rails are mounted on the internal side of carriage walls. During decking, the stop pins extend out of the connecting holes by clutch mechanism and connect with the positioning holes, so the connector and deck maneuver rails are fixed to each other and cannot slide. When it is necessary to adjust the height of decks, the stop pins of two neighboring yokes can be detached simultaneously from the positioning holes of corresponding deck maneuver rails and retract into the connecting holes of connector by merely using the clutch. The connector and deck maneuver rails would be separated from each other, so that the connector can slide up and down along the deck maneuver rails.

By fixing partitions in-between four yokes, the decks of this decking device have a larger area when compared to a single supporting joist. Therefore, its application can achieve the decking effect of combined usage of multi-decking device using a single supporting joist, and when compared to the successive adjustment of deck height on multi-decking device using a single supporting joist respectively, this decking device is more convenient, time and labor saving when adjusting deck heights.

In the carriage decking device, a positioning step is provided on external side of the yoke. The partition comprises a beam connecting in-between the positioning steps on two neighboring yokes and a platform is lap-joined with the beam. The side of each of the neighboring two yokes near the end edge of beam is connected with a sealing plate respectively.

The partition is using a combination of platform and beam. As the platform is a single piece of board, it is capable of achieving the effect of increasing the area of decks. In addition, as the platform is lap-joined with the beam, while the beam is connected in-between two neighboring yokes, therefore the use of clutch is still able to achieve the effect of simultaneous movement of stop pins on two yokes, i.e. still able to carry out adjustment easily. And in order to ensure that the platform will not fall from the beam, the sides of yokes may be closed by connecting with the sealing plates, so as an enclosed space between the four yokes is formed.

In the carriage decking device, as another type of technical solution, a positioning step is provided on external side of the yoke. The partition comprises a beam connecting in-between the positioning steps on two neighboring yokes and several parallel disposed supporting joists. The side of each of the neighboring two yokes near the end edge of beam is connected with a sealing plate respectively.

The method of applying combination of several supporting joists with beam has the same purpose with the above-mentioned application of platform and beam, both are able to increase the deck area of this decking device, but at the same time to ensure ease of making adjustments.

In the carriage decking device, the positioning step is L-shaped. A projecting latch is provided on vertical surface of the positioning step. The internal side of the beam is provided with catch. The latch on positioning step of neighboring two yokes connects with the catch on internal side of beam respectively.

The beam is connected with yokes by way of latch connection. Since the latch is disposed on vertical surface of the positioning step located at external sides of yokes, therefore the disposal of beam does not affect the connection between yokes and connector, and does not affect the action of clutch on two neighboring yokes too.

In the carriage decking device, the latch is L-shaped. There are two latches provided, both latches are symmetrically disposed on the vertical surface of positioning step. Two latches are disposed in order to improve the robustness of connection between the beam and yokes.

In the carriage decking device, the two vertically aligned and disposed stop pins are provided inside the mounting cavity of the yoke. The two stop pins are connected by two links in-between. The clutch comprises a rod. Both ends of the rod are located in the mounting cavity in-between two neighboring yokes. The end portion of rod passing through in-between the two links of the two stop pins. The rod located between the two links is provided with a bend. When both sides of bend are in contact with the sides of two links respectively, the two stop pins are enabled to connect with the positioning hole of corresponding deck maneuver rails or to detach from positioning hole.

Due to the rod in-between two links is provided with a bend, thus during a pulling outward of the rod, under the interaction of the two sides of bend with sides of two links, the stop pins project from the connecting holes out of the connector and insert into the positioning holes on deck maneuver rails, or detached from the positioning holes. And as both ends of the rod passing through the two stop pins of corresponding yokes in-between the two links respectively, hence the stop pins in neighboring two yokes will move simultaneously by pulling the rod. Since the partition is located in-between the four yokes, simultaneous movement of stop pins on two neighboring yokes can be achieved by the rod too. Therefore, while the deck area can be increased by using partition, the height of decks can be conveniently adjusted by using the rod too.

In the carriage decking device, both ends of the bend are provided with a projected arc surface respectively. Both arc surfaces are located on two sides of the bend respectively. When the two stop pins connect with the positioning holes of deck maneuver rails or detached from positioning holes, the two arc surfaces abut with the sides of two links respectively.

The deck area of present decking device is increased by partition. In the initial stage, arc surface located on one side of the rod bend abuts with the side of the outwardly disposed link located in-between two stop pins, and pushes the link outward during the pulling process. The two stop pins project from the connecting holes out of the connector and insert into the positioning holes on deck maneuver rails by the pushing force.

When there is a need to adjust the height, just push the rod in opposite direction. Arc surface located at the other side of rod bend abuts with the side of the inwardly disposed link located in-between two stop pins. During the process, the rod will push the link inward. The two stop pins are detached from the positioning holes on the deck maneuver rails by the pushing force and retract back to the connecting holes on connector. Since the partition is located in-between the four yokes, simultaneous movement of stop pins on two neighboring yokes can be achieved by the rod too. Therefore, while the deck area can be increased by using partition, the height of decks can be conveniently adjusted by using the rod too.

In the carriage decking device, a positioning block is fastened at the open end of the mounting cavity. The positioning block has a bored socket at its side. The end portion of the rod passing through the socket of positioning block. The sides of end portion of the rod is provided with two stopper holes. Corresponding mounting holes are provided on side wall of the socket. Spring and steel ball are provided in the mounting hole. The steel ball has the tendency of projecting out of the mounting hole and falls into the stopper hole under the elastic force of spring.

When the operator pulls the rod to insert the two stop pins into the corresponding positioning holes of deck maneuver rails, one of the stopper holes on rod aligns with the mounting hole on the side wall of socket. The steel ball projects out of the mounting hole and falls into the stopper hole under the elastic force of spring. And when the operator pulls the rod to detach the two stop pins from the positioning holes of deck maneuver rails and retract back to the connecting holes on connector, the mounting hole on the side wall of socket aligns with another stopper hole on the rod. Similarly, the ball will fall into the stopper hole under the elastic force of spring.

In the carriage decking device, the upper and lower sides of the mounting cavity are provided with a semi-circular positioning slot respectively, and both the stop pins are located in the positioning slot respectively. By mounting the two stop pins on the two semi-circular positioning slots, stability at the time of adjustment can be improved, ensuring that the stop pins will not traverse to the other directions apart from axial movement.

In the carriage decking device, one end portion of the rod is provided with a hook folded to one side. By folding one end portion of the rod into a hook, users can carry out adjustment easily, and more convenient in force application.

Compared with the prior art, the present carriage decking device is using four yokes to fix partitions. While the deck area is increased, it can also reduce the use of decking device inside carriage, thus saving logistics and transport costs. In addition, the present carriage decking device uses rod to connect two yokes, while taking advantage of a bend on the rod to achieve synchronous operation of stop pins in-between two neighboring yokes, so the operator can adjust the decking device height in a quick and easy manner, saving time and effort.

DETAILED DESCRIPTION OF THE INVENTION

Embodiments of this invention will be described below and the technical solutions of the invention will be further illustrated in connection with the accompanying figures. However, the present invention shall not be limited to these embodiments.

First Embodiment

Figure 1:
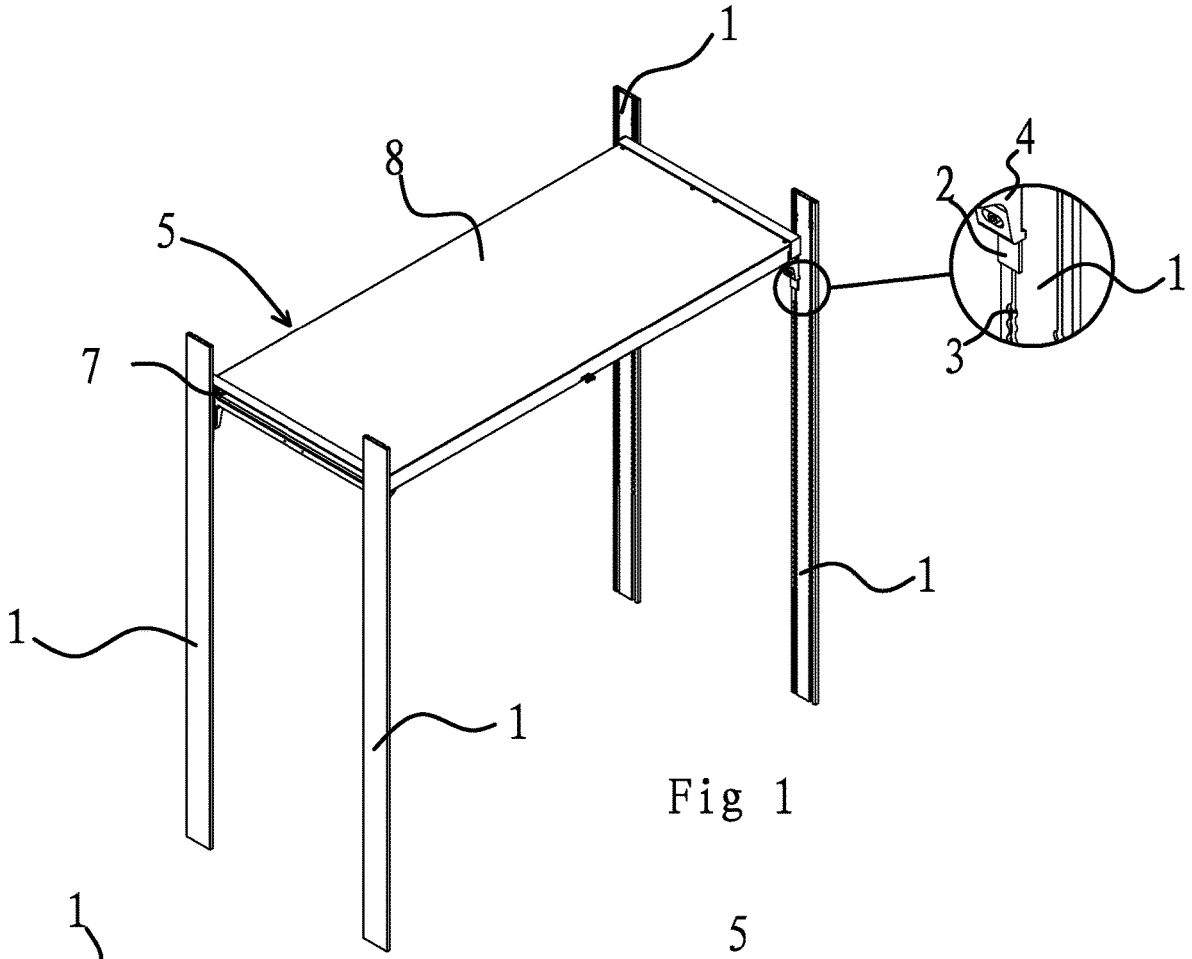
FIG. 1 is a structural schematic diagram showing one embodiment of the carriage decking device.
Figure 2A:
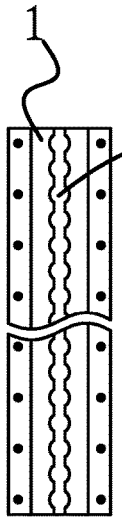
FIG. 2A is a front view diagram of one embodiment of part of a deck maneuver rail of the carriage decking device and FIG. 2B is a front view diagram of one embodiment of the carriage decking device in a state without deck maneuver rails.
Figure 2B:
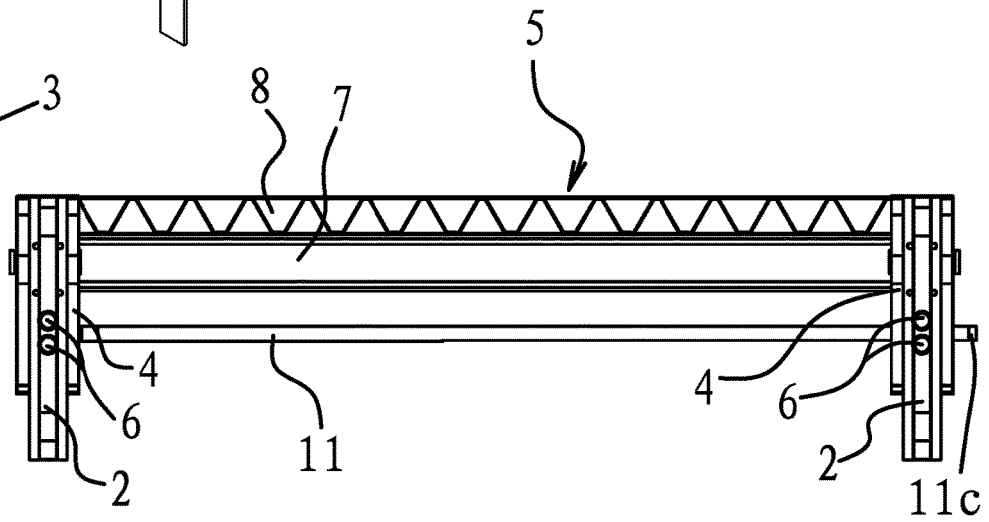
Figure 5:
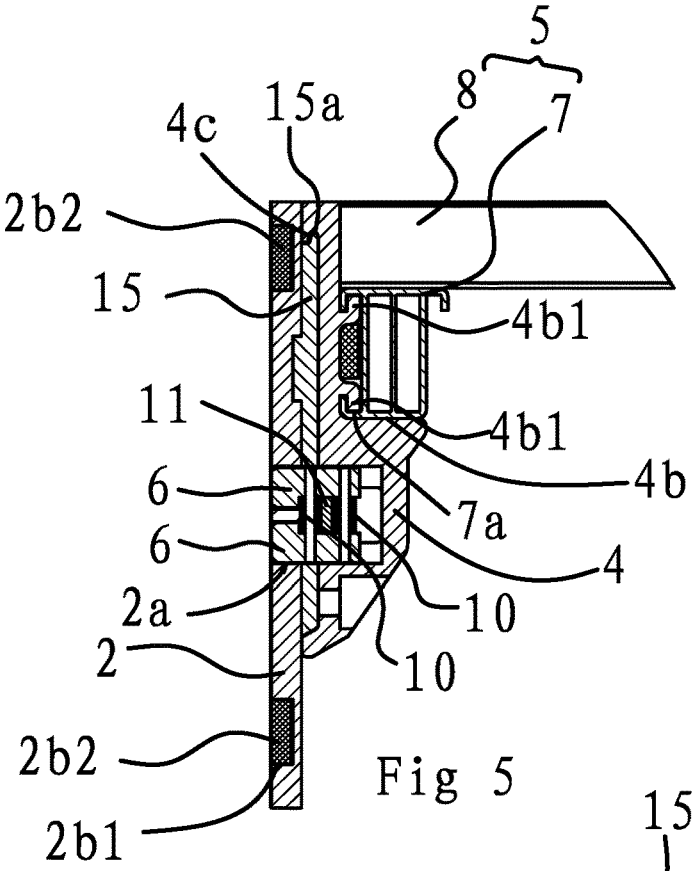
FIG. 5 is a cross-sectional diagram showing one embodiment of yokes and connector of the carriage decking device.
Figure 9:
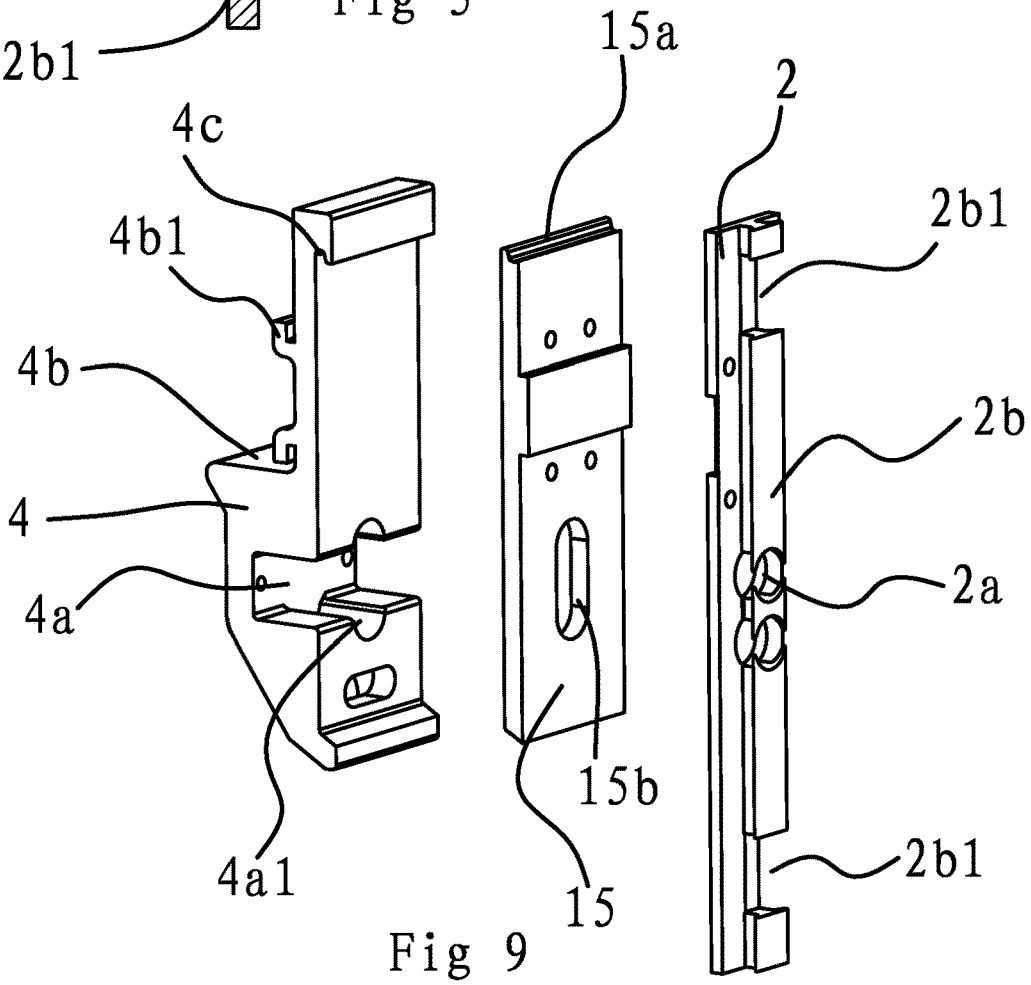
FIG. 9 is an exploded diagram of one embodiment of the yoke of carriage decking device.

As shown in FIGS. 1, 2A and 2B, a carriage decking device comprises four deck maneuver rails 1 arranged in pairs and opposite one another, and connectors 2, connected at the deck maneuver rails 1, and which are capable of sliding up and down along the deck maneuver rails 1. A certain number of positioning holes 3 are axially distributed on the deck maneuver rails 1. As shown in FIGS. 5 and 9, a projecting slider 2*b* is provided on the internal side of connector 2. Slider 2*b* is located in the deck maneuver rail 1. Both upper and lower ends of slider 2*b* have a notch 2*b*1. A plastic block 2*b*2 of matching shape with notch 2*b*1 is being connected with notch 2*b*1. Both the connector 2 and deck maneuver rail 1 are made of aluminum extruded sections. When the slider 2*b* of connector 2 slides on deck maneuver rail 1, a large frictional force is formed, and it gets stuck easily. Therefore, a plastic block 2*b*2 is disposed on upper and lower ends of slider 2*b* to reduce the frictional force during sliding, so the connector 2 can slide more smoothly.

As shown in FIGS. 5 and 9, a hanger 15 is securely connected on external sides of various connectors 2. A yoke 4 is securely connected on external side of hanger 15, and a partition 5 is fastened between the yokes 4. A projecting mating piece 15*a* is provided at upper end of hanger 15. An adapt groove 4*c* is provided at internal side of upper end of yoke 4, and the mating piece 15*a* snaps into adapt groove 4*c*. A positioning step 4*b* is provided on external side of yoke 4. The partition 5 comprises a beam 7 connecting in-between the positioning steps 4*b* on two neighboring yokes 4 and a platform 8 is lap-joined with the beam 7.

Figure 11:
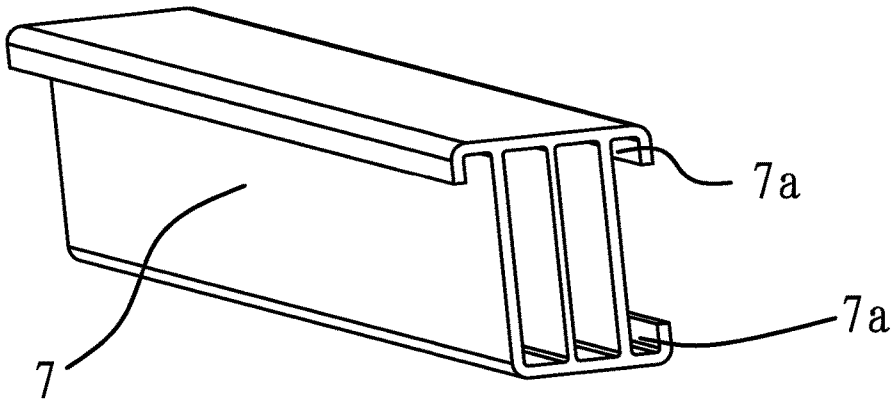
FIG. 11 is a structural schematic diagram of one embodiment of the beam of carriage decking device.

As shown in FIG. 9, the positioning step 4*b* is L-shaped. A projecting latch 4*b*1 is provided on vertical surface of the positioning step 4*b*. The latch 4*b*1 is L-shaped. There are two latches 4*b*1 provided, both latches 4*b*1 are symmetrically disposed on the vertical surface of positioning step 4*b*. As shown in FIG. 5 and FIG. 11, the internal side of beam 7 is provided with catch 7*a* at both upper and lower ends. Beam 7 connects with neighboring two yokes 4 by the matching operation of latch 4*b*1 and catch 7*a*. The side of each yoke 4 near the end edge of beam 7 is connected with a sealing plate 9 to prevent the platform 8 from falling off beam 7.

Figure 3:
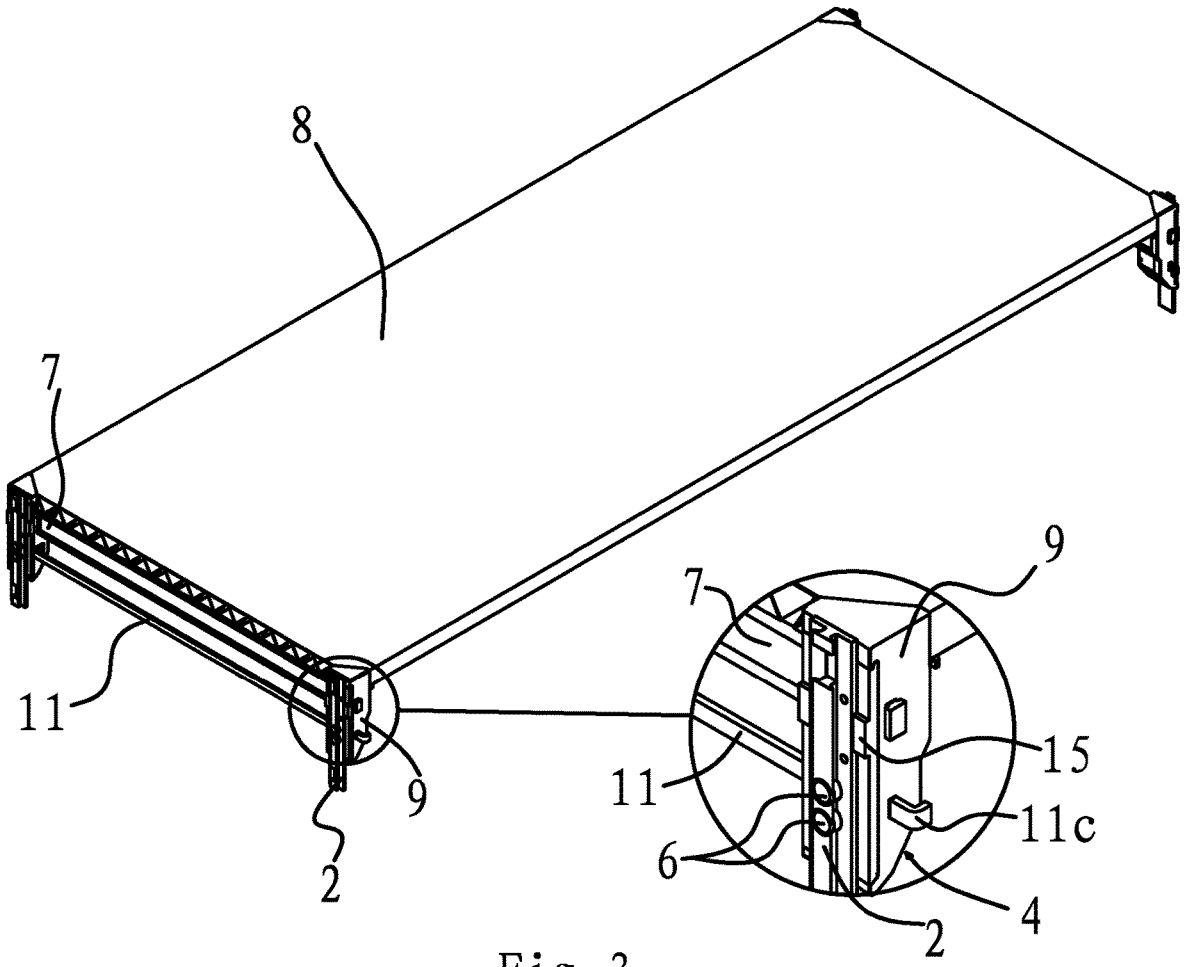
FIG. 3 is a schematic diagram of one embodiment of the carriage decking device in a state without deck maneuver rails.
Figure 6:
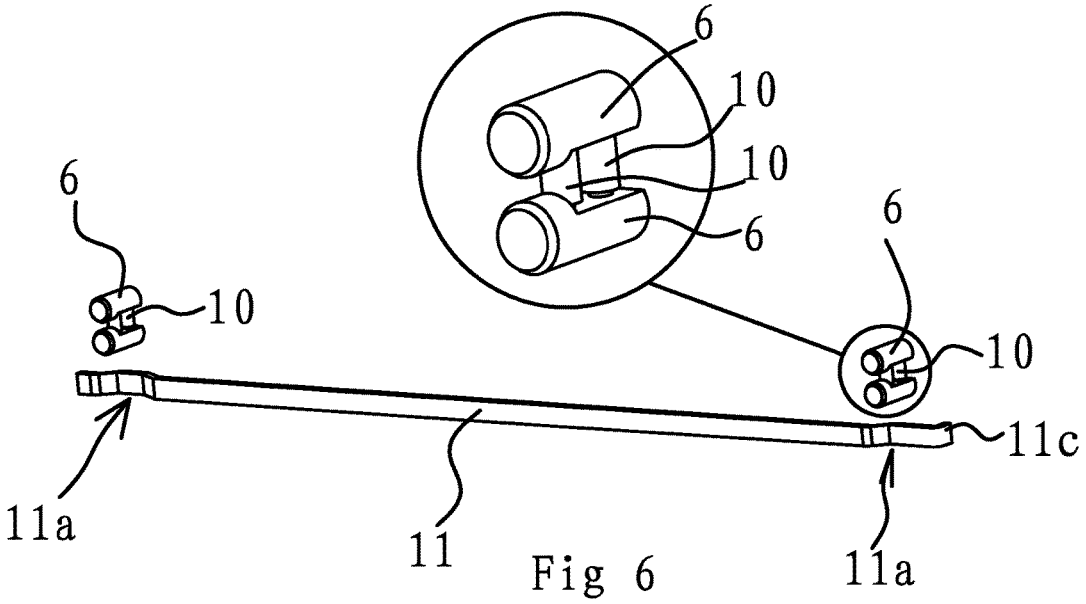
FIG. 6 is a schematic diagram showing one embodiment of the rod and stop pin of the carriage decking device.

As shown in FIGS. 3 and 9, a depressed mounting cavity 4*a* is provided on the internal side of yoke 4, the upper and lower sides of mounting cavity 4*a* are provided with a mutually aligned positioning slot 4*a*1. Combined with FIG. 4, the positioning slot 4*a*1 is semi-circular in shape. Stop pins 6 are provided in both the positioning slots 4*a*1. The sides of both stop pins 6 are connected by two links 10. Connecting holes 2*a* are provided on connector 2. The stop pins 6 passing through a hole 15*b* of the hanger 15 and extend into connecting holes 2*a*. As shown in combination with FIG. 4. a clutch that enables the stop pins 6 in the mounting cavities 4*a* to connect with the positioning holes 3 of corresponding deck maneuver rails 1 or to detach from the positioning holes 3 simultaneously is provided between two neighboring yokes 4. As shown in combination with FIGS. 6, 7, and 8, the clutch comprises a rod 11. Both ends of rod 11 are located in the mounting cavity 4*a* in-between two neighboring yokes 4. The end portion of rod 11 passing through in-between the two links 10 of the two stop pins 6 respectively. And the rod 11 located between the two links 10 is provided with a bend 11*a*. Both ends of the bend 11*a* are provided with a projected arc surface 11*a*1 respectively. Both arc surfaces 11*a*1 are located on two sides of the bend 11*a* respectively. In this embodiment, one end portion of the rod 11 is folded inward forming a hook 11*c* for easier rod 11 operation by the operator.

Figure 4:
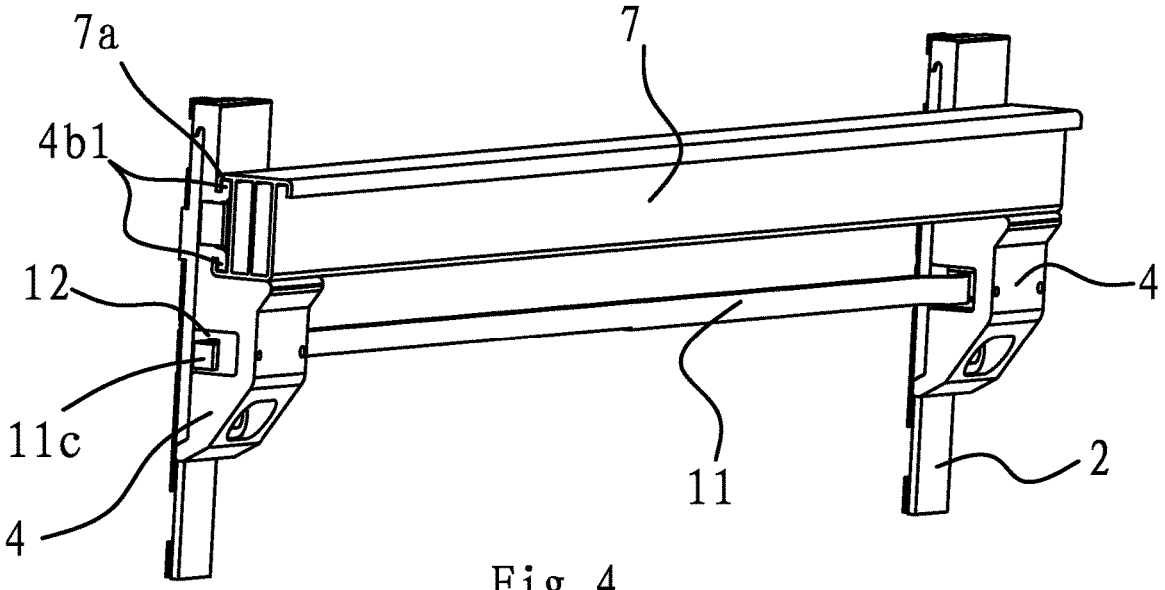
FIG. 4 is a rear view schematic diagram showing one embodiment of two neighboring yokes of the carriage decking device in a state without deck maneuver rails or a platform.
Figure 10A:
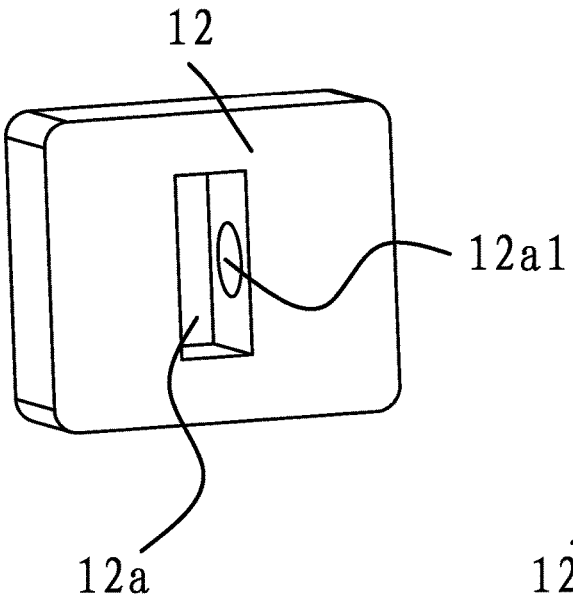
FIG. 10A is a schematic of one embodiment of the positioning block of carriage decking device and FIG. 10B is a cross-sectional diagram of FIG. 10A.
Figure 10B:
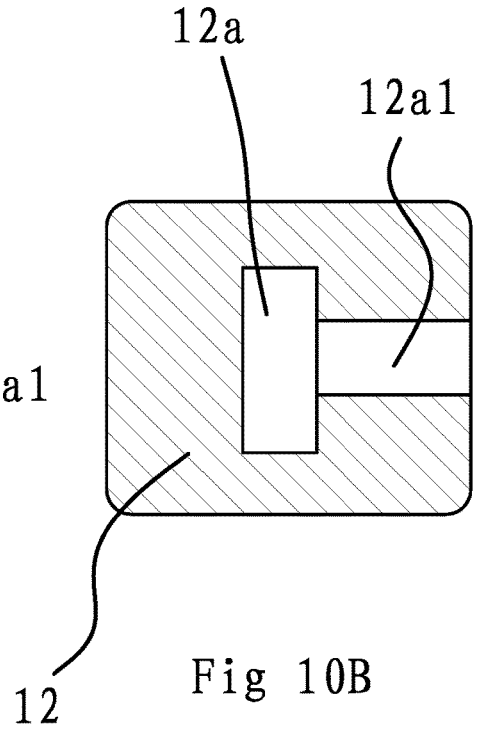

As shown in FIGS. 4, 10A, and 10B, a positioning block 12 is fastened at the open end of mounting cavity 4*a*. The positioning block 12 has a bored socket 12*a* at its side. The end portion of rod 11 passing through the socket 12*a* of positioning block 12. The sides of end portion of rod 11 are provided with two stopper holes 11*b*. Corresponding mounting holes 12*a*1 are provided on side wall of socket 12*a*. Spring 13 and steel ball 14 are provided in the mounting hole 12*a*1. The steel ball has the tendency of projecting out of the mounting hole 12*a*1 and falls into the stopper hole 11*b* under the elastic force of spring 13.

While assembling, four deck maneuver rails 1 are arranged in pairs. The arranged deck maneuver rails 1 are placed facing one another and fastened on internal wall of carriage. Connectors 2 are then connected to each of the deck maneuver rails 1, so connectors 2 are capable of sliding up and down along the deck maneuver rails 1 through their inner slider 2*b*. Various connectors 2 are securely connected with hangers 15, and through these hangers 15, connectors 2 are connected on internal sides of yokes 4. Two stop pins 6 which are connected by two links 10 in-between are disposed in two positioning slots 4*a*1 of mounting cavity 4*a*. Rod 11 is then passed through in-between two links 10 of two stop pins 6 in two neighboring yokes 4 respectively. Beam 7 is then connected with neighboring two yokes 4 by the mating operation of latch 4*b*1 and catch 7*a*, and finally platform 8 is lap-joined on two beams 7.

Figure 8:
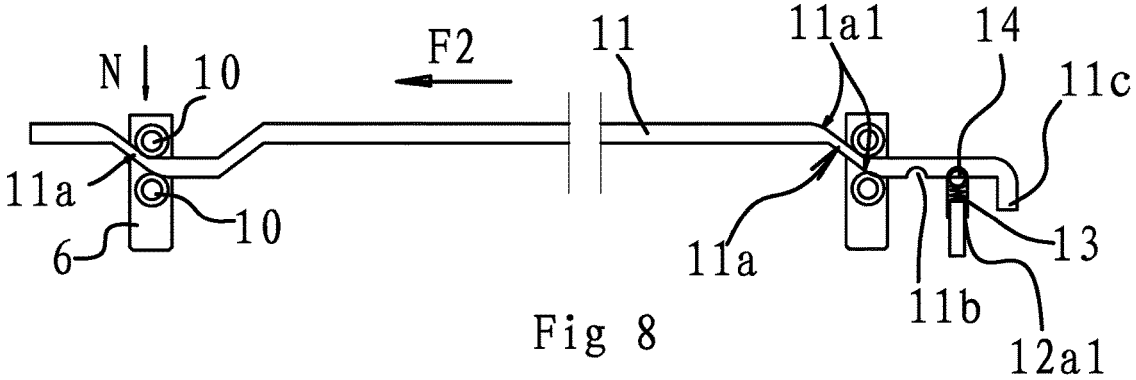
FIG. 8 is a schematic diagram showing one embodiment of the rod and stop pin of the carriage decking device when connector is in a free state relative to the deck maneuver rails.

As shown in FIG. 8, under normal conditions (also as shown in FIG. 5 and FIG. 3), connectors 2 are connected in the deck maneuver rails 1 through slider 2*b* on their internal sides. The arc surface 11*a*1 on one side of bend 11*a* of rod 11 abutted with the side of the outwardly disposed link 10 located in-between two stop pins 6, and pushed the stop pins 6 out from the connecting holes 2*a* of connectors 2 and inserted into the positioning holes 3 of deck maneuver rails 1. The connectors 2 are therefore fastened with deck maneuver rails 1. At this time, connectors 2 cannot slide with respect to deck maneuver rails 1. Meantime, one of the stopper holes 11*b* at end portion of rod 11 aligned directly opposite to mounting hole 12*a*1 on side wall of socket 12*a* on positioning block 12. The steel ball 14 located in mounting hole 12*a*1 partly falls in the stopper hole 11*b* under the elastic force of spring 13, so the rod 11 would not move freely as no external force exists.

Figure 7:
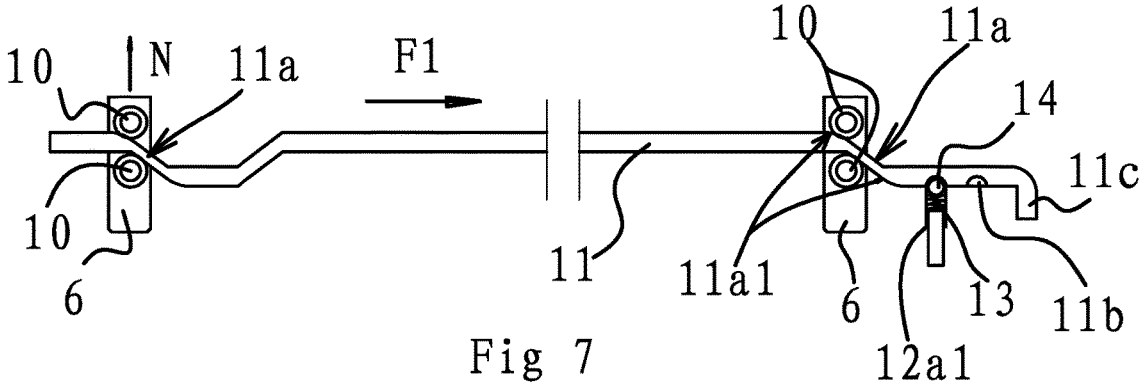
FIG. 7 is a schematic diagram showing one embodiment of the rod and stop pin of the carriage decking device when connector is in a fixed state relative to the deck maneuver rails.

As shown in FIG. 7, when it is necessary to adjust the height of platform 8, the operator can pull the rod 11 by applying force F2 on hook 11*c* at end portion of rod 11. During the process of pulling rod 11, steel ball 14 comes out from its existing location in stopper hole 11*b* and retract back into mounting hole 12*a*1. During the process of pulling rod 11, the arc surface 11*a*1 on the other side of bend 11*a* of rod 11 abutted with the side of the inwardly disposed link 10 located in-between two stop pins 6, and applied an inward compressive force to the links 10. The stop pins 6 moved inwards by the compressive force N and detached from positioning holes 3 on deck maneuver rails 1. The connector 2 and deck maneuver rails 1 no longer mutually fastened. Pulling of rod 11 is continued until another stopper hole 11*b* at its end portion aligned with the mounting hole 12*a*1 of positioning block 12. Steel ball 14 again partly falls in the stopper hole 11*b* under the elastic force of spring 13, and rod 11 is again being locked in position. The operator can perform adjustment freely. After the adjustment is completed, the operator again pushed rod 11 inwards by force F1 so that stop pins 6 are inserted into the positioning holes 3 of deck maneuver rails 1 again for connection.

The decking device has secured the platform 8 by the disposal of four yokes 4. The decking area of decking device is increased, thus the number of decking devices in carriage being used can be reduced, and cost of logistics can be saved. At the same time, as the stop pins 6 in-between two neighboring yokes 4 could be controlled synchronously by using one single rod 11, hence it would be very convenient to perform height adjustment when necessary. The operator can adjust the height of two neighboring yokes 4 simultaneously just by pulling rod 11. It is time and effort saving, as well as enabling the whole decking device to be adjusted quickly.

Second Embodiment

The structure and principles of this embodiment is basically the same as First Embodiment, except the following difference:

In this embodiment, positioning steps 4*b* are provided on external sides of yokes 4. The partition 5 comprises a beam 7 connecting in-between the positioning steps 4*b* on two neighboring yokes 4 and several parallel disposed supporting joists. Both ends of supporting joists are lap-joined with the beam 7 in-between various neighboring yokes 4 respectively. The side of each of the neighboring two yokes 4 near the end edge of beam 7 is connected with a sealing plate 9 respectively. Similar effect of increasing decking area could be achieved by using a plurality number of supporting joists. Meantime, when compared with platform 8, a certain interval can be set up between various supporting joists, hence meeting the need of decking as well as saving material cost.

Third Embodiment

The structure and principles of this embodiment is basically the same as First Embodiment, except the following difference:

In this embodiment, a connecting board is disposed in-between the mounting cavities 4*a* of two neighboring yokes 4. The stop pins 6 are secured at end portion of connecting board. A limit spring is disposed between the connecting board and mounting cavity 4*a*. The clutch comprises a connecting rod disposed under platform 8 and steel wire rope connected between the connecting rod and connecting board. Both ends of limit spring are being placed against the connecting board and mounting cavity 4*a* respectively. The steel wire rope passing through the rotating rod, and both ends of steel wire rope are connected on the connecting board in-between various two neighboring yokes 4 respectively. Both ends of limit spring are placed against the connecting board and positioning seat respectively. Under normal conditions, stop pins 6 extended out from connecting holes 2*a* on connector 2 by the elastic force of limit spring and inserted into positioning holes 3 on deck maneuver rails 1, so that the connector 2 and deck maneuver rails 1 are mutually fixed in place. At this time, the connector 2 cannot slide on corresponding deck maneuver rail 1.

As both ends of steel wire rope passed through the rotating rod and connected with the connecting board in-between two neighboring yokes 4 respectively, thus when the rotating rod is rotated, the connecting board is pulled by steel wire rope, causing the stop pins 6 on connecting board to overcome the elastic force of limit spring due to the pulling effect, thus moved inwards and detached from positioning holes 3. At this time, connector 2 and deck maneuver rails 1 no longer fixed mutually, and hence the connector 2 can slide on corresponding deck maneuver rail 1. The description of the preferred embodiments thereof serves only as an illustration of the spirit of the invention. It will be understood by those skilled in the art that various changes or supplements in form and details may be made therein without departing from the spirit and scope of the invention as defined by the appended claims.

LIST OF REFERENCE NUMERALS

1 Deck maneuver rail
2 Connector
2*a* Connecting hole
2*b* Slider

2b1 Notch
2b2 Plastic block
3 Positioning hole
4 Yoke
4a Mounting cavity
4a1 Positioning slot
4b Positioning step
4b1 Latch
4c Adapt groove
5 Partition
6 Stop pin
7 Beam
7a Catch
8 Platform
9 Sealing plate
10 Link
11 Rod
11a Bend
11a1 Arc surface
11b Stopper hole
11c Hook
12 Positioning block
12a Socket
12a1 Mounting hole
13 Spring
14 Steel ball
15 Hanger
15a Mating piece

What is claimed is:

1. A carriage decking device, comprising:

four deck maneuver rails (1) arranged in pairs, each pair opposite an opposing pair;

connectors (2) connected at the deck maneuver rails (1), the connectors (2) capable of sliding up and down along the deck maneuver rails;

a plurality of positioning holes (3) are axially distributed on the deck maneuver rails (1);

yokes (4) connected on external sides of each connector (2);

a partition (5) fastened on the yokes (4);

a depressed mounting cavity (4a) provided on an internal side of the yoke (4);

stop pins (6) provided inside the mounting cavity (4a);

a connecting hole (2a) that aligns with the stop pins (6), the connecting hole (2a) is provided on the connector (2), and the stop pins (6) extend into the connecting hole (2a); and a clutch provided between two neighboring yokes (4), the clutch having a rod (11);

wherein two ends of the rod (11) are located in the mounting cavity (4a) in-between two neighboring yokes (4) and each end of the rod (11) connects with corresponding stop pins (6); and wherein the stop pins (6) move simultaneously to connect with or to detach from the positioning holes (3) of corresponding deck maneuver rails (1) when moving the rod (11).

2. The carriage decking device as claimed in claim 1, further comprising:

a positioning step (4b) on an external side of the yoke (4);

wherein the partition (5) comprises a beam (7) connecting in-between the positioning steps (4b) on two neighboring yokes (4) and a platform (8) is lap-joined with the beam (7).

3. The carriage decking device as claimed in claim 1, further comprising:

a positioning step (4b) on an external side of the yoke (4);

wherein the partition (5) comprises a beam (7) connecting in-between the positioning steps (4b) on two neighboring yokes (4) and several parallel disposed supporting joints.

4. A carriage decking device as claimed in claim 2 wherein the positioning step (4b) is L-shaped;

wherein projecting latch (4b1) is provided on a vertical surface of the positioning step (4b);

wherein an internal side of the beam (7) is provided with a catch (7a); and wherein the latch (4b1) on positioning step (4b) of neighboring two yokes (4) connects with the catch (7a) on an internal side of beam (7) respectively.

5. A carriage decking device as claimed in claim 4 wherein the latch (4b1) is L-shaped; and wherein there are two latches (4b1) provided, both latches (4b1) are symmetrically disposed on a vertical surface of the positioning step (4b).

6. A carriage decking device as claimed in claim 1 wherein there are two stop pins (6), the two stop pins (6) are vertically aligned and disposed inside the mounting cavity (4a) of the yoke (4), and the two stop pins (6) are connected by two links (10) in-between;

wherein each end portion of the rod (11) passes through in-between the two links (10) of the two stop pins (6), and the rod (11) is provided with two bends (11a) that are located between the two links (10);

wherein when a first side of the bend (11a) is in contact with a first link of the two links (10), the two stop pins (6) connect with the positioning hole (3) of corresponding deck maneuver rails (1); and wherein when a second side of the bend (11a) is in contact with a second link of the two links (10), the two stop pins (6) detach from positioning hole (3).

7. A carriage decking device as claimed in claim 6 wherein two ends of the bend (11a) are each provided with a projected arc surface (11a1) respectively, and the two arc surfaces (11a1) are located on two sides of the bend (11a) respectively; and wherein when the two stop pins (6) connect with the positioning holes (3) of deck maneuver rails (1) or when the two stop pins (6) detach from positioning holes (3), the two arc surfaces (11a1) abut with sides of two links (10) respectively.

8. A carriage decking device as claimed in claim 7 wherein a positioning block (12) is fastened at an open end of the mounting cavity (4a);

wherein the positioning block (12) has a bored socket (12a) at a side of the positioning block (12);

wherein an end portion of the rod (11) passes through the socket (12a) of the positioning block (12);

wherein sides of the end portion of the rod (11) are provided with two stopper holes (11b);

wherein a corresponding mounting hole (12a1) is provided on a side wall of the socket (12a);

wherein a spring (13) and a steel ball (14) are provided in the mounting hole (12a1); and wherein the steel ball (14) has tendency of projecting out of the mounting hole (12a1) and falling into one of the stopper holes (11b) under an elastic force of the spring (13).

9. A carriage decking device as claimed in claim 1 wherein upper and lower sides of the mounting cavity (4a) are each provided with a semi-circular positioning slot (4a1) respectively;

wherein there are two stop pins (6); and wherein the two stop pins (6) are each located in a corresponding positioning slot (4*a*1) respectively.

10. A carriage decking device as claimed in claim 6 wherein one end portion of the rod (11) is provide with a hook (11*c*) folded to one side.

11. A carriage decking device as claimed in claim 2 wherein a side of each of the two neighboring yokes (4) near an end edge of the beam (7) is connected with a sealing plate (9) respectively.

12. A carriage decking device as claimed in claim 2 wherein there are two stop pins (6), the two stop pins (6) are vertically aligned and disposed inside the mounting cavity (4*a*) of the yoke (4), and the two stop pins (6) are connected by two links (10) in-between;

wherein each end portion of the rod (11) passes through in-between the two links (10) of the two stop pins (6), and the rod (11) is provided with two bends (11*a*) that are located between the two links (10);

wherein when a first side of the bend (11*a*) is in contact with a first link of the two links (10), the two stop pins (6) connect with the positioning hole (3) of corresponding deck maneuver rails (1); and wherein when a second side of the bend (11*a*) is in contact with a second link of the two links (10), the two stop pins (6) detach from positioning hole (3).

13. A clutch, comprising:

two connectors (2) capable of sliding up and down along the deck maneuver rails;

two yokes (4), connected on external sides of each connector (2);

a depressed mounting cavity (4*a*) provided on an internal side of the yoke (4);

stop pins (6) provided inside the mounting cavity (4*a*);

a connecting hole (2*a*) that aligns with the stop pins (6), the connecting hole (2*a*) is provided on the connector (2), and the stop pins (6) extend into the connecting hole (2*a*); and a rod (11) provided between two neighboring yokes (4);

wherein two ends of the rod (11) are located in the mounting cavity (4*a*) in-between two neighboring yokes (4) and each end of the rod (11) connects with corresponding stop pins (6); and wherein the stop pins (6) move simultaneously to plug in or to detach from positioning holes (3) of corresponding deck maneuver rails (1) when moving the rod (11).

14. A clutch as claimed in claim 13 wherein there are two stop pins (6), the two stop pins (6) are vertically aligned and disposed inside the mounting cavity (4*a*) of the yoke (4), and the two stop pins (6) are connected by two links (10) in-between;

wherein each end portion of the rod (11) passes through in-between the two links (10) of the two stop pins (6), and the rod (11) is provided with two bend (11*a*) that are located between the two links (10);

wherein when a first side of the bend (11*a*) is in contact with a first link of the two links (10), the two stop pins (6) connect with the positioning hole (3) of corresponding deck maneuver rails (1); and wherein when a second side of the bend (11*a*) is in contact with a second link of two links (10) the two stop pins (6) detach from positioning hole (3).

15. A clutch as claimed in claim 14 wherein two ends of the bend (11*a*) are each provided with a projected arc surface (11*a*1) respectively, and the two arc surfaces (11*a*1) are located on two sides of the bend (11*a*) respectively; and wherein when the two stop pins (6) connect with the positioning holes (3) of deck maneuver rails (1) or when the two stop pins (6) detach from positioning holes (3), the two arc surfaces (11*a*1) abut with sides of two links (10) respectively.

16. A clutch as claimed in claim 15 wherein a positioning block (12) is fastened at an open end of the mounting cavity (4*a*);

wherein the positioning block (12) has a bored socket (12*a*) at a side of the positioning block (12);

wherein an end portion of the rod (11) passes through the socket (12*a*) of the positioning block (12);

wherein sides of the end portion of the rod (11) are provided with two stopper holes (11*b*);

wherein a corresponding mounting hole (12*a*1) is provided on a side wall of the socket (12*a*);

wherein a spring (13) and a steel ball (14) are provided in the mounting hole (12*a*1); and wherein the steel ball (14) has tendency of projecting out of the mounting hole (12*a*1) and falling into one of the stopper holes (11*b*) under an elastic force of the spring (13).

17. A clutch as claimed in claim 16 wherein upper and lower sides of the mounting cavity (4*a*) are each provided with a semi-circular positioning slot (4*a*1) respectively;

wherein there are two stop pins (6); and wherein the two stop pins (6) are each located in a corresponding positioning slot (4*a*1) respectively.

18. A clutch as claimed in claim 17 wherein one end portion of the rod (11) is provide with a hook (11*c*) folded to one side.

* * * * *